United States Patent [19]

Blackburn

[11] 3,991,980

[45] Nov. 16, 1976

[54] FENCE BORDER GUARD

[75] Inventor: Edward Blackburn, Homestead, Fla.

[73] Assignee: Lawrence Peska Associates, Inc., New York, N.Y. ; a part interest

[22] Filed: Apr. 19, 1976

[21] Appl. No.: 671,312

[52] U.S. Cl. ..... 256/45
[51] Int. Cl.[2] ..... B21F 27/00
[58] Field of Search ..... 256/1, 48, 58, 32, 45

[56] References Cited

UNITED STATES PATENTS

| | | | |
|---|---|---|---|
| 2,814,466 | 11/1957 | Golobay | 256/32 |
| 3,195,863 | 7/1965 | Korecky et al. | 256/1 |

*Primary Examiner*—Werner H. Schroeder
*Assistant Examiner*—Doris L. Troutman

[57] ABSTRACT

The open areas along the lower edge of a wire fence are blocked by two adjacent angle guards on opposite sides of the fence. One of the angle guards includes a bend at the top which overlaps the other shorter angle guard. The bent portion is slotted at intervals along the length of the fence to receive the interleaved wires while the sections between the slots extends through the openings in the wire mesh to overlap the top of the other angle guard. Bolts through holes in the vertical sides of the angles secure the two guards together and anchor pegs through holes in the horizontal base plates hold the guards in the ground. This clears the area along the fence of weeds and undergrowth and acts as a guide for a lawn mower to facilitate trimming grass at the edges of the fence guard.

6 Claims, 2 Drawing Figures

FENCE BORDER GUARD

BACKGROUND OF THE INVENTION

1. Field of the Invention

The present invention relates to fence guards and particularly to angled guards for blocking the open areas below a wire fence.

2. Description of the Prior Art

Presently known fence guards for blocking areas beneath a wire mesh fence have utilized L-shaped angles placed against opposite sides of the fence, or a flexible connected M-shaped guard with the wire fence fitting into the middle groove. Examples of such types are shown in U.S. Pat. No. 3,713,624 issued Jan. 30, 1973 and No. 3,768,780 issued Oct. 30, 1973. These devices however, were somewhat difficult to connect to the fence and were not directly secured to the wire mesh.

SUMMARY OF THE INVENTION

It is therefore the primary object of the present invention to provide an improved fence guard which is secured to the wire mesh in a simplified manner.

This is accomplished with a pair of angle guards connected together through opposite sides of the wire mesh at the base of the fence. One of the guards has a bend along the upper end with spaced slots to accommodate the cross linked wires. The sections of the bend between the slots extend through the mesh over the upper edge of the opposite angle guard. Bolts through holes in the vertical sides of the angles secure the two guards about the wire mesh and anchor pegs through holes in the base plate hold the guards in the ground. The area adjacent the fence is maintained clear of grass and weeds with the guards providing a barrier and guide for a lawn mower to facilitate trimming of the grass along the edges. Other objects and advantages will become apparent from the following description in conjunction with the accompanying drawings.

DESCRIPTION OF THE PREFERRED EMBODIMENT

Figure 1:
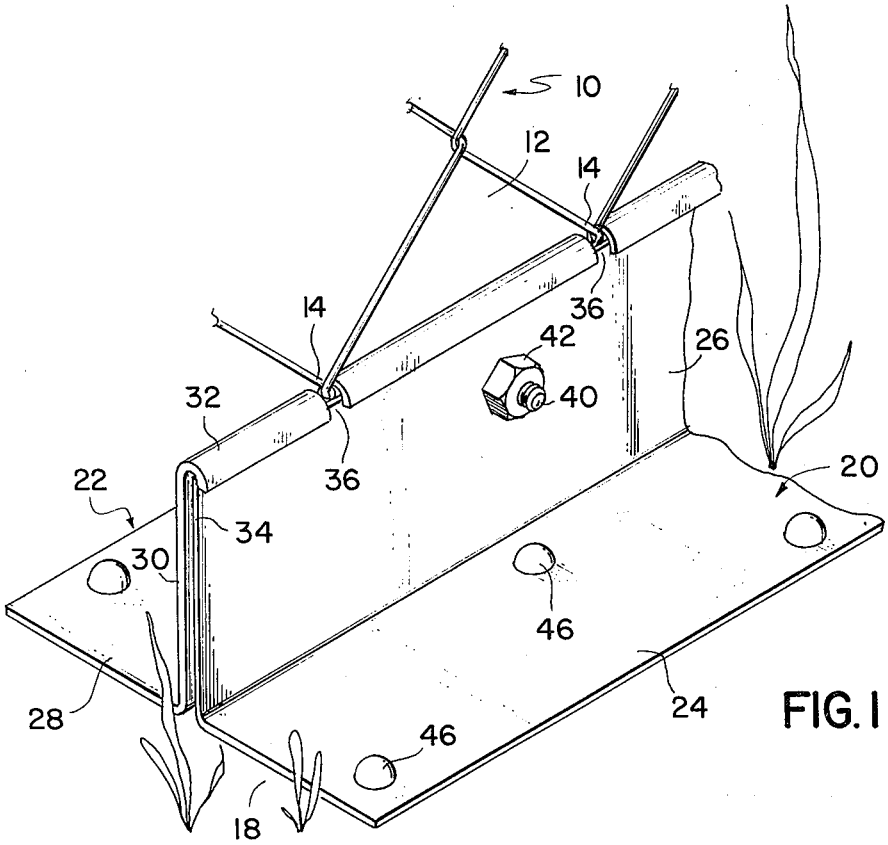
FIG. 1 is a pictorial representation of a portion of the wire mesh fence and border guard.
Figure 2:
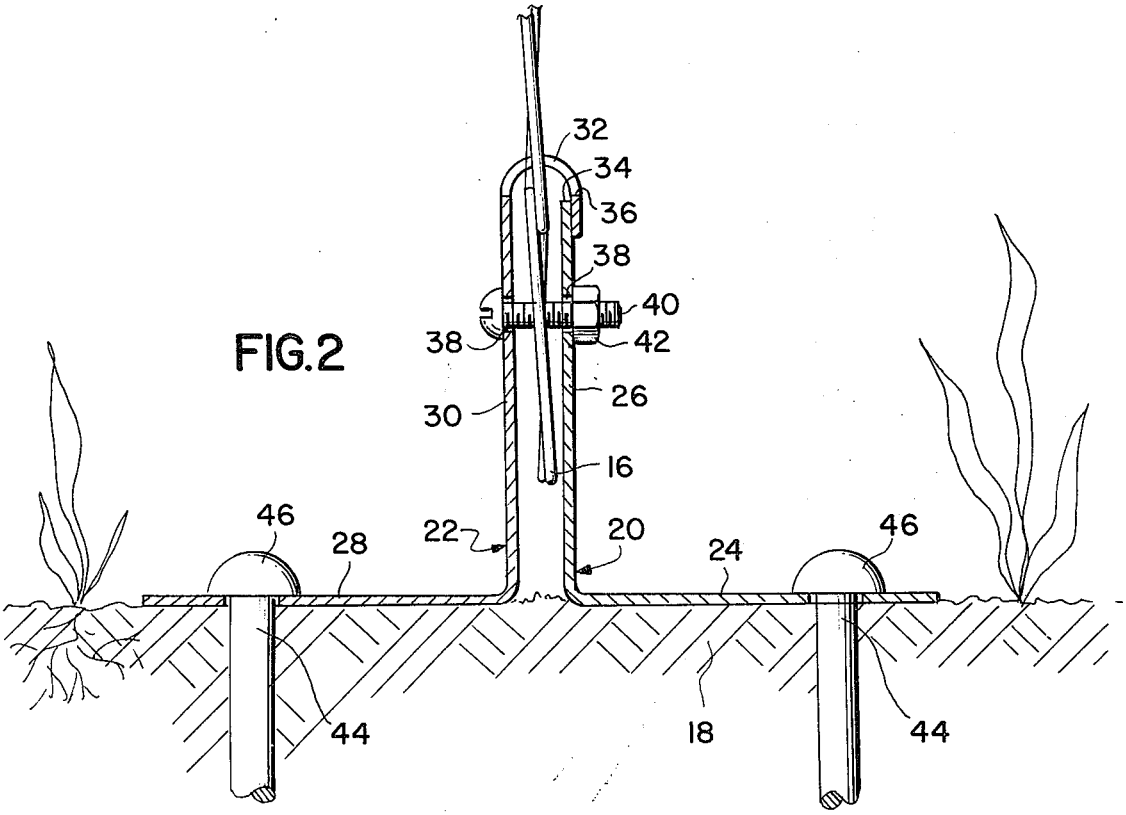
FIG. 2 is a side cross-sectional view of the guard secured to the bottom of the fence.

As shown in FIGS. 1 and 2, a standard chain link or wire mesh fence 10 includes a plurality of interleaved crossing wires connected together in a diamond shaped pattern having openings 12 between the wire links 14. The fence is supported on vertical posts, not shown, and the lower edge 16 of the wire mesh is spaced above the ground 18. In order to block this space between the ground and the bottom of the fence, a pair of angle guards 20, 22 are provided along opposite sides of the fence. Angle guard 20 includes a base plate 24, extending along the ground under one side of the fence, and a vertical side 26 adjacent and parallel to the wire mesh.

Angle guard 22 includes a similar base plate 28 along the ground on the other side of the fence and a vertical side 30 parallel to the mesh. The upper end of side 30 has a bent portion 32 extending through the openings 12 in the mesh and overlapping the upper edge 34 of side 26 which is shorter than side 30. A series of spaced slots 36 along the bent portion accommodate the wire links 14. A plurality of aligned holes 38 through the opposite vertical sides 26, 30 receive bolts 40 which are fastened to the angles by nuts 42. The bolts and overlapping edges thus secure the angles about the sides of the fence. In addition, a plurality of holes 44 and anchor pegs 46 through base plates 24, 28 secure the angles to the ground below the fence.

The engaging angle guards thus provide a simple effective secure barrier to prevent growth of grass and weeds under the fence and act as a guide for a lawn mower in trimming the edges of the grass along the border. The guards may be made of a suitable sheet metal or thick plastic in typical lengths of about 4 to 6 feet. The base plates may be about 4 inches wide and the sides about 2 to 3 inches in height. The slots may be about ½ inch wide 1¼ inch deep and spaced about 3¼ inches apart. The bolts and pegs may be spaced at about one foot apart, all of these dimensions being merely exemplary.

While only a single embodiment has been illustrated and described, it is apparent that many variations may be made in the particular design and configuration without departing from the scope of the invention as set forth in the appended claims.

What is claimed is:

1. A fence guard for a wire link fence comprising:

a first angle guard adapted to be mounted along the ground on one side of said fence, said first base plate and a first substantially vertical side;

a second angle guard adapted to be mounted along the ground on the opposite side of said fence, said second angle guard including a second base plate and a second substantially vertical side, said second side having a bent portion at the upper end adapted to extend through openings in said fence and overlap the upper edge of said first side, said bent portion including a plurality of shots spaced along the length of said second guard and adapted to accommodate the wire links in said fence; and means for securing said first and second angle guards together about the sides of said fence.

2. The device of claim 1 including means for securing said angle guards to the ground adjacent said fence.

3. The device of claim 2 wherein said first and second vertical sides have aligned holes, said means for securing said guards together including a bolt fitting through said holes.

4. The device of claim 3 wherein said base plates have holes therein, said means for securing said guards to the ground including anchor pegs extending through said holes in said base plates into the ground.

5. The device of claim 4 wherein said vertical sides of said angle guards are positioned about the opposite sides of said fence and secured at the bottom of said fence blocking the area between said bottom and the ground.

6. The device of claim 5 wherein said first vertical side is shorter than said second vertical side.

* * * * *